US006510874B2

(12) United States Patent
Hasenkopf

(10) Patent No.: US 6,510,874 B2
(45) Date of Patent: Jan. 28, 2003

(54) DISTRIBUTION SYSTEM FOR GASES

(76) Inventor: Karl-Peter Hasenkopf, Ohmstrasse 10, 92521 Schwarzenfeld (DE)

( * ) Notice: Subject to any disclaimer, the term of this patent is extended or adjusted under 35 U.S.C. 154(b) by 0 days.

(21) Appl. No.: 09/770,772

(22) Filed: Jan. 26, 2001

(65) Prior Publication Data

US 2001/0037838 A1 Nov. 8, 2001

(30) Foreign Application Priority Data

Mar. 29, 2000 (DE) ..... 100 15 444
Apr. 6, 2000 (DE) ..... 100 17 252

(51) Int. Cl.[7] ..... B65B 1/04
(52) U.S. Cl. ..... 141/2; 141/18; 141/83
(58) Field of Search ..... 141/2, 18, 83, 141/192, 3, 37, 39, 40, 47, 98, 231

(56) References Cited

U.S. PATENT DOCUMENTS 4,567,923 A * 2/1986 Nalbach ..... 141/82
4,657,055 A * 4/1987 Poulsen ..... 141/83
5,913,344 A * 6/1999 Wronski et al. ..... 141/4

* cited by examiner

*Primary Examiner*—Steven O. Douglas
(74) *Attorney, Agent, or Firm*—Kriegsman & Kriegsman

(57) ABSTRACT

The disclosure directed to a distribution system for gas in gas bottles with a reservoir (3) for gas bottles (2) from which the gas bottles (2) can be removed with controlled access and/or to which the gas bottles (2) can be preferentially returned with controlled access characterised in that outside the reservoir (4) at least one filling station (12) is provided to fill the gas bottles (2) with the gas.

20 Claims, 6 Drawing Sheets

DISTRIBUTION SYSTEM FOR GASES

I. FIELD OF THE INVENTION

The present invention relates to a distribution system, and in particular to an automatic sales apparatus, for gases.

II. BACKGROUND OF THE INVENTION

The invention relates to a distribution system, and in particular to a sales system like an automatic sales apparatus, for gases, especially for industrial gases and/or gases for energy supply or as energy carriers, for example propane gas.

A sales system of this general type is already known (DE 196 52 147). The problem for the invention is to improve such a system in terms of its usability.

III. SUMMARY OF THE INVENTION

In order to solve this problem a system has been developed according to the claims.

The invention is directed to a distribution system for gas in gas bottles with a reservoir for gas bottles from which the gas bottles can be removed with controlled access and/or to which the gas bottles can be preferentially returned with controlled access. In one aspect of the invention, outside the reservoir at least one filling station is provided to fill the gas bottles with the gas. In another aspect of the invention, the reservoir is designed to accommodate at least one means of transport for gas bottles and is provided with means to remove and/or insert gas bottles from off the means of transport. In yet another aspect of the invention, for controlled access to the reservoir and/or to the filling station, there is provided at least one sensor which interacts with a bottle identification on the bottle (2), for example, with a chip, a transponder, with a strip or colour coding on the bottle and/or an image recognition device.

The invention is further directed to a process for distributing gas, in which a distribution system automatically evaluates, based on certain parameters, how to provide gas to a customer. This is done by automatically evaluating if a new bottle is required, and taking one or several measures to refill the bottle returned by the customer, or to fill another bottle or provide one prefilled.

Further advantages, aspects and details of the present invention become evident from the dependent claims, the specification and the accompanying drawings.

IV. BRIEF DESCRIPTION OF THE DRAWINGS

DETAILED DESCRIPTION OF THE INVENTION

Figure 1:
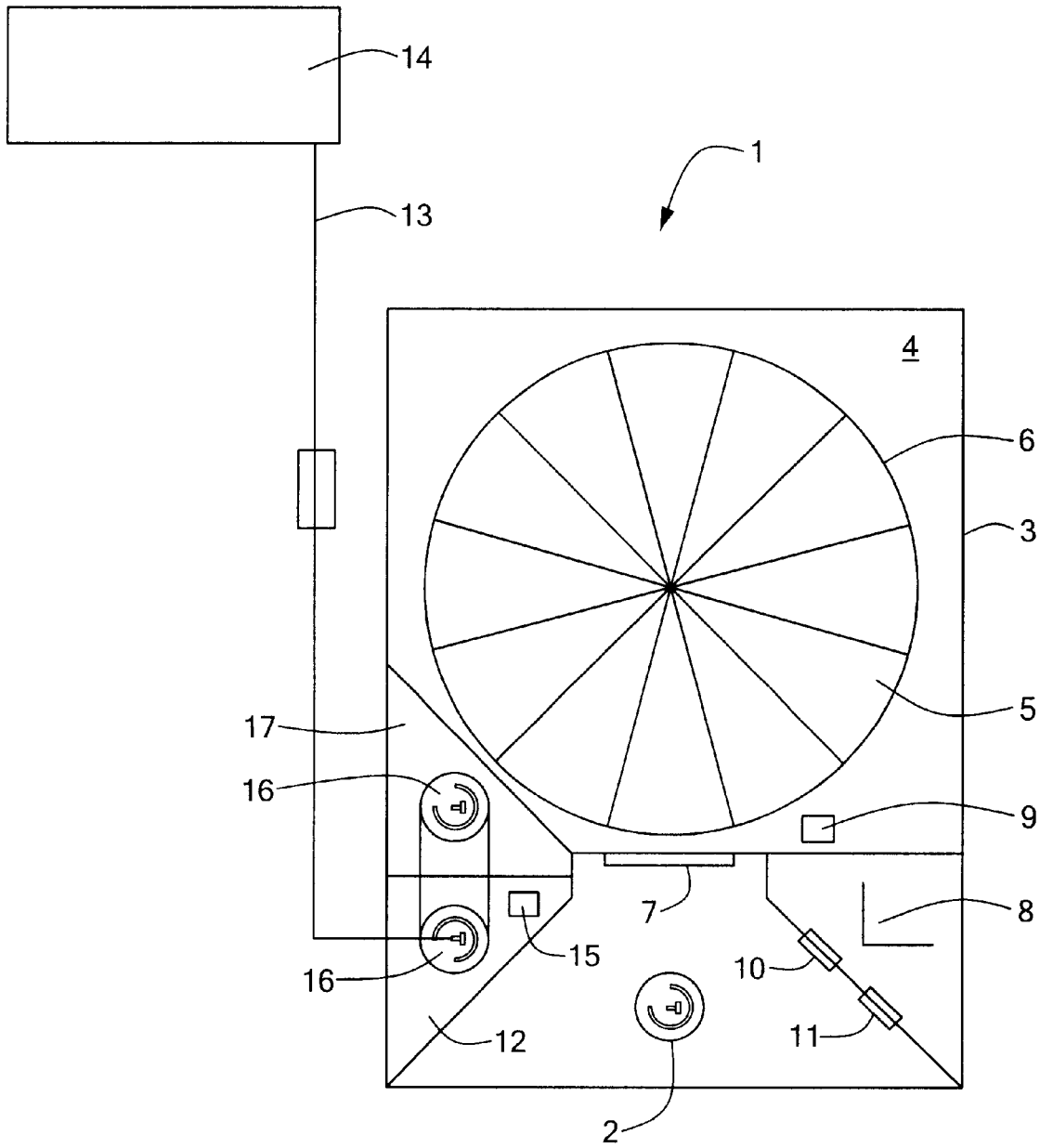
FIG. 1 shows an automatic gas apparatus according to the invention in a general view.

In the distribution system of the present invention, the invention combines a return and exchange station with a filling station for gas bottles. This combination enables the inventive distribution system to decide whether a new bottle is asked for, a returned bottle should be refilled or whether it is, for some reason, appropriate to replace a returned bottle with another one supplied to either the filling station or/and a bottle supply of prefilled bottles.

In one aspect, the invention is directed to a distribution system for gas in gas bottles with a reservoir for gas bottles from which the gas bottles can be removed with controlled access and/or to which the gas bottles can be preferentially returned with controlled access. It is characterized in that outside the reservoir at least one filling station is provided to fill the gas bottles with the gas.

In a further aspect, the invention is directed to a distribution system for gas in gas bottles with a reservoir for gas bottles from which the gas bottles can be removed with controlled access and/or to which the gas bottles can be preferentially returned with controlled access, which system is characterised in that the reservoir is designed to accommodate at least one means of transport for gas bottles and is provided with means to remove and/or insert gas bottles from off the means of transport.

The inventive distribution system can preferably be designed to allow for the transport of gas bottles from the reservoir to the filling station and/or vice versa.

Still further, the invention is directed to a distribution system for gas in gas bottles with a reservoir for gas bottles from which the gas bottles can be removed with controlled access and/or to which the gas bottles can be preferentially returned with controlled access. This system is characterised in that for controlled access to the reservoir and/or to the filling station there is provided at least one sensor which interacts with a bottle identification on the bottle, for example, with a chip, a transponder, with a strip or colour coding on the bottle and/or an image recognition device.

The reservoir is preferably designed to accommodate at least one means of transport for gas bottles and is provided with means to remove and/or insert gas bottles from off the means of transport.

Preferably, outside the reservoir at least one filling station is provided for filling the gas bottles with the gas.

Further, in the reservoir there may be provided a receiving system having several receivers for one gas bottle each and each receiver can be moved to a delivery point and/or bottle feed for a gas bottle.

In order to achieve the controlled access, there preferably is provided at least one controlled delivery point and/or controlled bottle feed.

Also, for controlled access to the reservoir and/or to the filling station, there may be provided at least one sensor which interacts with a bottle identification on the bottle, for example, with a chip, a transponder, with a strip or colour coding on the bottle and/or an image identification device.

Further, means for automatically filling the bottles may preferably be provided. These means may include means for testing the bottles for leakage, and means for emptying the bottles from any gas contained therein.

The means of transport, if present, may be pallets or magazines or containers or container-like devices.

In a preferred embodiment of the invention, the reservoir may comprise several planes one above the other, for storing gas bottles, so that a higher number of gas bottles may be stored in the inventive distribution system without increasing the area required for the distribution system.

The invention is further directed to a process for distributing gas. This process will preferably be run on a distribution system according to the invention or a distribution system similar to this system. Hence, the invention is directed to a process for distributing gas in gas bottles with a distribution system having a filling station and a reservoir for gas bottles, comprising the following steps:

automatically evaluating if a new gas bottle is required for distributing the gas selected by a consumer;

based on the result of the evaluation, selecting at least one of the actions of the group of actions consisting of: a) refilling a gas bottle provided by the consumer; b) providing an empty gas bottle from the reservoir of gas bottles in the distribution system, c) filling an empty gas bottle, provided from the reservoir, d) storing the gas bottle provided by the consumer, in the reservoir, e) providing a prefilled gas bottle from the reservoir, and f) rejecting an unaccepted gas bottle.

The automatic evaluation may be done based on several factors. These factors include, but are not limited to: the kind and quantity of gas selected by the consumer (if more than one gas can be distributed by the distribution system), the kind of bottle provided, the kind of bottle required, the condition of the bottle (leakage etc.), the quantity of gas in the tank of the distribution system, the number of empty and/or prefilled gas bottles contained n the reservoir etc. The invention does not reside in the particular factors concerned but in the automatic evaluation of these factors by a micro controller, a special electronic circuit, or even a mechanical device in the distribution system, and in the process of deciding what action should be performed in response to these factors.

The actions include, but are not limited to the above listed ones. Further, in any particular distribution system, it is not necessary that all of the above listed actions can be performed. Based on the particular embodiment, also a subset of the above action may be suitable to perform the inventive process. The actions may also be combined in a succession of actions, if need be.

The refilling of a gas bottle can e.g. be performed if the gas bottle is suitable, is positioned in the filling station, and show no faults when being refilled. A gas bottle is considered suitable in terms of the present invention, if it is a gas bottle which can be filled in the filling station, is able to hold the kind and quantity of gas selected by the consumer, and (if desired), belongs to the company managing the distribution system. In contrast to this, even a gas bottle which might be suitable for refilling, can still be an unaccepted gas bottle, if it does not belong to the company managing the distribution system. Further factors which can be preset might also render a gas bottle unaccepted.

If, for some reason, a new gas bottle is required, this can be provided from the reservoir of gas bottles. The gas bottle may be an empty gas bottle or a prefilled one, depending on the capabilities and layout of the distribution system, and on further requirements determined by the evaluation process (number of bottle stored, residual gas in tank, kind of gas bottle etc.).

Depending on the concrete embodiment used in a distribution system, a gas bottle provided from the reservoir, might also be automatically filled with the gas. Alternatively, in some embodiments, an indication may be given that the consumer should transfer the empty gas bottle to the filling station for refilling.

Finally, in some embodiments, the inventive process may also allow for automatically transferring the gas bottle (if it cannot be refilled) provided by the consumer, to a space in the reservoir where it can be stored for later inspection, repair, or exchange.

In a particular embodiment, the process is characterized in that the distribution system comprises a filling station and a reservoir containing prefilled bottles, with a bottle delivery point, and that at least one of the actions is selected based on evaluating:

if the consumer provides a suitable bottle to the filling station, refilling the gas bottle;

if the consumer provides a defective or unsuitable gas bottle, of a fault occurs during the refilling of the gas bottle, providing a prefilled gas bottle from the reservoir to the delivery point;

if the consumer provides an unaccepted gas bottle, rejecting that gas bottle; and if the tank of the filling station is empty, providing a prefilled gas bottle from the reservoir to the delivery point.

Alternatively, the process can be characterized in that the distribution system comprises a filling station and a reservoir containing empty bottles, with a bottle delivery point, and that at least one of the actions is selected based on evaluating:

if the consumer provides a suitable bottle to the filling station, refilling that gas bottle;

if the consumer provides a defective or unsuitable gas bottle, of a fault occurs during the refilling of the gas bottle, providing an empty gas bottle from the reservoir to the delivery point; and if the consumer provides an unaccepted gas bottle, rejecting that gas bottle.

If need be, the distribution system may indicate to the consumer to insert the empty bottle provided from the reservoir, into the filling station.

In a further embodiment, the inventive process may be characterized in that the distribution system comprises a filling station and a reservoir containing prefilled bottles, with a bottle delivery point and a bottle feed, and that at least one of the actions is selected based on evaluating:

if the consumer provides a suitable gas bottle to the filling station, refilling that gas bottle;

if the consumer provides a defective or unsuitable gas bottle, or a fault occurs during the refilling of the gas bottle, providing a prefilled gas bottle from the reservoir to the delivery point;

if the consumer provides an unaccepted gas bottle, rejecting that gas bottle;

if the tank of the filling station is empty, providing a prefilled gas bottle from the reservoir to the delivery point; and if the consumer returns a gas bottle to the reservoir via the bottle feed, providing a prefilled gas bottle from the reservoir to the delivery point.

The inventive process may also be characterized in that the distribution system comprises a filling station and a reservoir containing empty bottles, with a bottle delivery point and a bottle feed, and that at least one of the actions is selected based on evaluating:

if the consumer provides a suitable bottle to the filling station, refilling that gas bottle;

if the consumer provides a defective or unsuitable gas bottle, or a fault occurs during the refilling of the gas bottle, providing an empty gas bottle from the reservoir to the delivery point;

if the consumer provides an unaccepted gas bottle, rejecting that gas bottle; and if the consumer returns a gas bottle to the reservoir via the bottle feed, providing another, empty gas bottle from the reservoir to the delivery point.

Further, the inventive process may be characterized in that the distribution system comprises a filling station, and a reservoir containing prefilled gas bottles, with a bottle delivery point and a transporter for transporting empty gas bottles from the reservoir to the filling station and for transporting defective or unsuitable gas bottles from the filling station to the reservoir, and that at least one of the actions is selected based on evaluating:

if the consumer provides a suitable gas bottle to the filling station, refilling the gas bottle;

if the consumer provides a defective or unsuitable gas bottle, or a fault occurs during the refilling of the gas bottle, transporting the defective or unsuitable gas bottle to the reservoir and providing an empty gas bottle from the reservoir to the filling station and filling the bottle;

if the consumer provides an unaccepted gas bottle, rejecting that gas bottle;

if the tank of the filling station is empty, providing a prefilled gas bottle from the reservoir to the delivery point; and if no empty bottles are contained in the reservoir, providing a prefilled gas bottle from the reservoir to the delivery point.

VI. EXAMPLES

The invention will be explained subsequently with reference to FIGS. 1–6, which show various embodiments of the system or automatic gas apparatus according to the invention in simplified representation and viewed from above, respectively.

A. Example 1

The automatic gas apparatus shown as a general view in FIG. 1 is used to sell gas, for example industrial gas and/or a gas for energy supply (e.g. propane gas) in suitable bottles of which one bottle 2 is shown schematically in FIG. 1 and has a square shape when viewed from above. The automatic apparatus is further used to return gas bottles 2 no longer required or defective gas bottles 2. The bottles can however exhibit any other suitable shape and are made of a suitable material for gas bottles, for example, steel, aluminium, plastic and if necessary can have a single- or multi-layer casing.

The automatic apparatus 1 essentially consists of a housing 3 that forms a reservoir for the bottles 2 and has several receivers to accommodate gas bottles 2 provided in its interior 4.

In the embodiment shown, the receivers 5 are constructed on a turntable 6 which can be rotated about a vertical axis, in a single plane or in several vertical planes one above the other. At the front of the automatic apparatus 1 there is provided a flap or door 7 which can be opened and closed in a controlled manner by means of a control device 8 such that when the shutter or delivery point 7 is open, the receiver 5 positioned at this shutter is accessible for the removal of a gas bottle 2 or for the return of an unneeded gas bottle 2 as appropriate. At the various receivers 5 and/or in the vicinity of the delivery point 7 there are provided sensors, one of which is denoted by 9 in FIG. 1, and which serve to identify the gas bottles 2, and in particular to identify the type and/or the size and/or the age and/or the owner of the gas bottle 2. These sensors respond, for example, to an identification applied to one of the bottles 2, formed for example by a code such as colour coding or transponder identification and/or a chip applied to one of the bottles 2 etc. In addition to these sensors 9 or instead of these, an image recognition can also be provided. Thus, a bottle 2 can only be returned to the automatic apparatus 1 if this is a permissible bottle 2.

Near the shutter 7 also at the front of the automatic gas apparatus 1 there are provided operating facilities which can be used for example to perform a cash-free gas sale safely, for example an indicator display 10, an input 11, for example with a card reader to read a permissible card used by the appropriate customer, e.g. customer and/or credit card or cards for cash-free payments from which important customer data, comprising at least the data required for a calculation, can be read out to the control system 8 when operating the automatic gas apparatus 1. For example, the card reader can also be used to read cards from which amounts of money can be debited and which can be recharged, as is already known for telephone cards and mobile phone cards.

A special feature of the automatic gas apparatus 1 is that at the front of the automatic apparatus there is provided a filling station 12 with which empty gas bottles 2 can be filled from a source for the desired gas, where the customer positions the empty gas bottle 2 in this filling station 12 and then, of course after obtaining the customer data required for the calculation, for example, after inserting the customer card into the card reader, the filling process proceeds automatically. The filling station 12 is connected via a gas pipe 13 with a pump to a source for the gas outside the housing 3. In the embodiment shown the source comprises a tank 14. Suitable gas sources however also include rail transport containers, centralised or decentralised gas stores connected to the automatic gas apparatus 1 or the tank 14 via a gas pipe, and also remote pipes connected to the automatic gas apparatus 1 or its tank 14 etc.

At the filling station 12 there is provided a sensor 15, corresponding to the sensor 9, to identify the bottle positioned at the filling station 12. The filling process is only initiated by the filling station 12 when the gas bottle positioned at the filling station 12 is in fact a bottle accepted by the automatic gas apparatus which is monitored with the aid of the sensor 15. If the positioned gas bottle is a bottle accepted by the automatic gas apparatus or a permissible bottle, the filling process is initiated automatically by the filling station 12 and the filling station is hereby locked to access from the outside. The filling process is monitored continuously during filling. If errors occur during filling, for example leakages at the gas bottle 2 to be filled and/or in the connection between the filling station and/or the local filling element or head 16 and the bottle, the filling process is stopped and the relevant bottle with the appropriate filling head 16 of the filling station is conveyed into a chamber 17 which is sealed tightly towards the outside and in which the gas bottle 2 at which the fault appeared during filling is slowly emptied and the relevant gas is taken off into another tank (not shown). The customer is notified to this effect at the display 10 and, after the delivery point 7 is opened or released, can remove an empty gas bottle 2 from the receiver 5 standing ready behind this, which can then be filled in the filling station 12.

For example, the automatic gas apparatus 1 is constructed or equipped such that the turntable 6 partly contains empty gas bottles 2 and partly contains gas bottles 2 already filled with gas, whereby control is such that in the normal case a customer who has no gas bottle 2 for refilling at the filling station 12 receives an empty gas bottle 2 from a receiver 5 of the turntable 6 which is then filled up at the filling station 12. Only when the filling station 12 is blocked because of faulty filling does the user receive an already filled gas bottle via the delivery point 7, i.e., the receivers 5 of the turntable 6 are partly kept free for the return of empty gas bottles 2, partly occupied by empty gas bottles 2 and a certain part is occupied by already filled gas bottles 2. It is also feasible for the receivers 5 to be differently configured.

The automatic gas apparatus 1 can also be constructed as an automatic sales apparatus for accessories required in connection with the gas bottles 2, for example for the selective purchase of pressure regulators, seals, gases hoses etc.

B. Example 2

Figure 2:
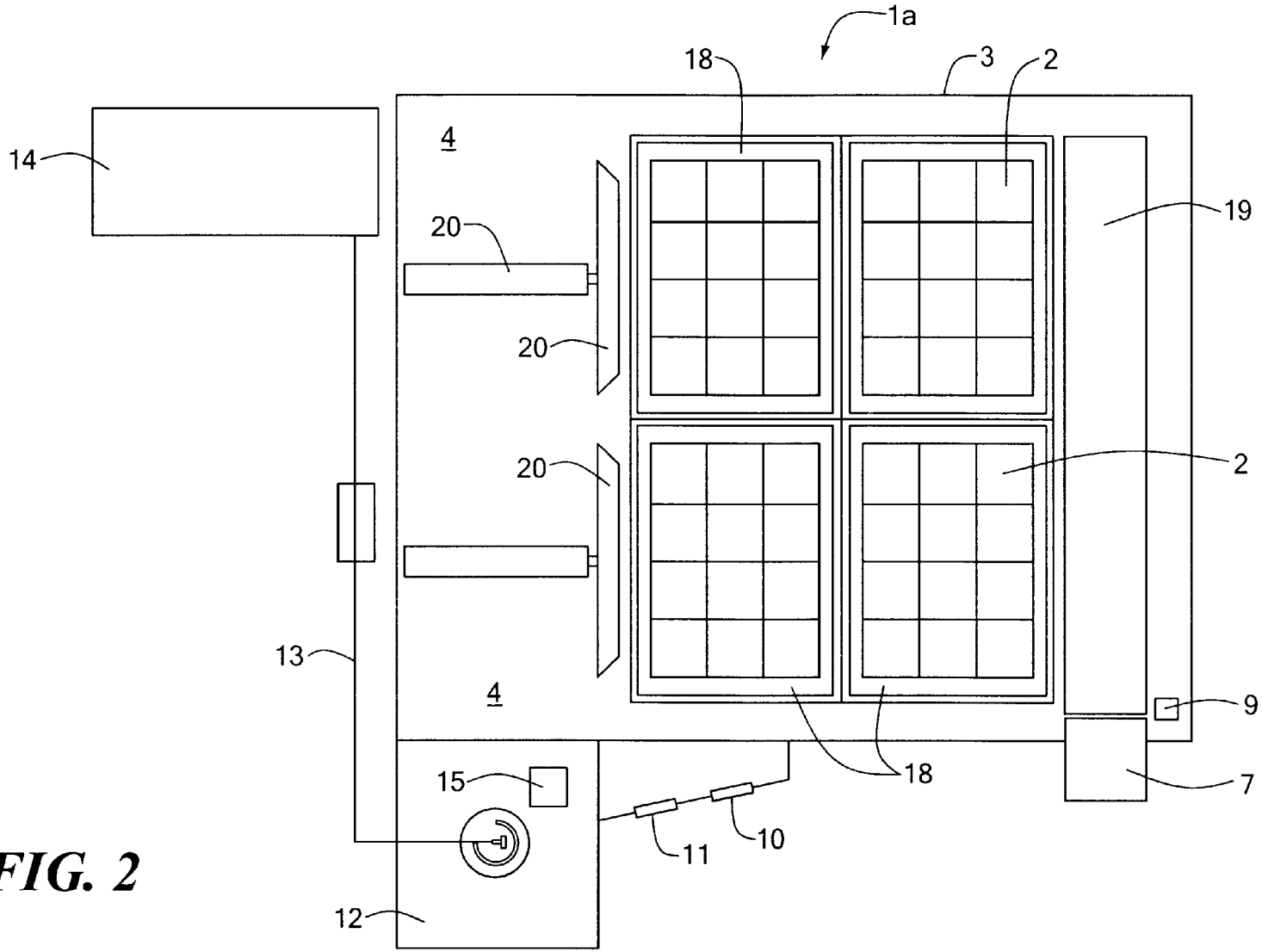
FIG. 2 shows a further embodiment of an automatic gas apparatus according to the invention with means of transport.

As another possibility FIG. 2 shows an automatic sales apparatus for gas 1*a* which essentially differs from the automatic sales apparatus for gas 1 in that the gas bottles 2 inside the housing 3 are not held ready in receivers of a turntable but on means of transport, i.e. on pallets 18 in the embodiment shown, which are used to transport a plurality of sets of gas bottles.

In order to load the automatic sales apparatus for gas with gas bottles 2 or to remove the returned gas bottles 2 which must be sent back for repair and/or inspection, the interior 4 of the housing 3 is accessible via a lockable door.

In the embodiment shown four pallets 18 are arranged in one plane and in two parallel rows each containing two pallets 18 inside the interior 4 of the housing 3 and such that in this figure the right row of pallets is parallel to a transporter 19 and lies adjacent to this, which has one end ending at the delivery point 7*a* corresponding to the delivery point 7.

The bottles 2 arranged on the pallets 18 are, for example, empty bottles. With the aid of transverse conveying means, which are formed of pushing elements 20 in the embodiment shown, the gas bottles 2 are moved sideways in rows onto the transporter 19. Whenever a customer requires a bottle 2, the first bottle 2 from the row of bottles formed on the transporter 19 is output to the delivery 7. The customer can then refill this bottle at the filling station 12.

If all bottles 2 of a row of bottles formed on the transporter 19 have been output, the next row of bottles is formed on the transporter 19 with the aid of the pushing element 20, and so on.

A particular advantage of the automatic sales apparatus for gas 1*a* compared with the automatic sales apparatus for gas 1 is that for loading the automatic apparatus 1*a* the bottles 2 remain on their means of transport or on their pallet 18, the bottles 2 do not need to enter the special receivers of the automatic gas apparatus 1*a* but rather the means of transport or pallets 18 form such receivers.

Otherwise, the method of operation and functioning of the automatic sales apparatus for gas corresponds to that described previously for the automatic apparatus 1.

C. Example 3

Figure 3:
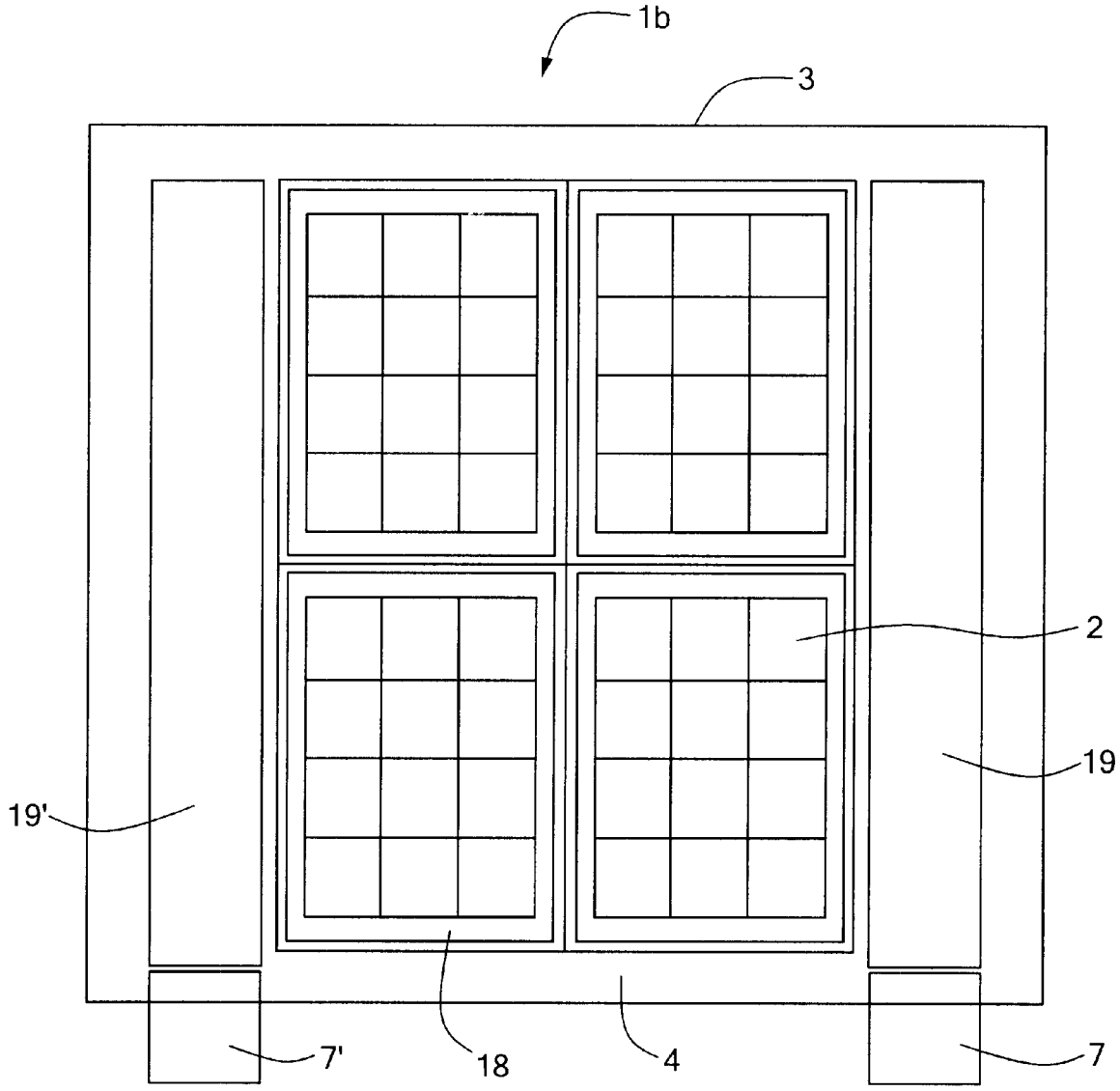
FIG. 3 shows a simplified representation of an automatic sales apparatus for gas according to the invention similar to the embodiment shown in FIG. 2 with two transporters.

FIG. 3 shows a simplified representation of an automatic sales apparatus for gas 1*b* which essentially corresponds to the automatic sales apparatus for gas 1*a* but has a transporter 19 or 19' on either side of the region provided to receive the pallet 18, that is the transporter 19 with the delivery point 7 and the transporter 19, with the bottle feed 7' so that automatic sales apparatus for gas 1*b* can also be used to return gas bottles 2 via the bottle feed 7'. These returned bottles 2 then form a row of bottles on the transporter 19'. If the number of bottles in the row of bottles corresponds to the number of free places on the neighbouring pallets 18, the row of returned bottles 2 is moved over sideways onto the neighbouring pallets so that a new row of returned bottles can be formed on the transporter 19' which can then be moved again sideways onto the neighbouring pallets 18 whereby the rows already standing on the returned pallets are moved further by the width of a row.

The empty bottles 2 are delivered to the delivery point 7 via the transporter 19 in the same manner as described previously for the automatic apparatus 1*a*.

D. Example 4

Figure 4:
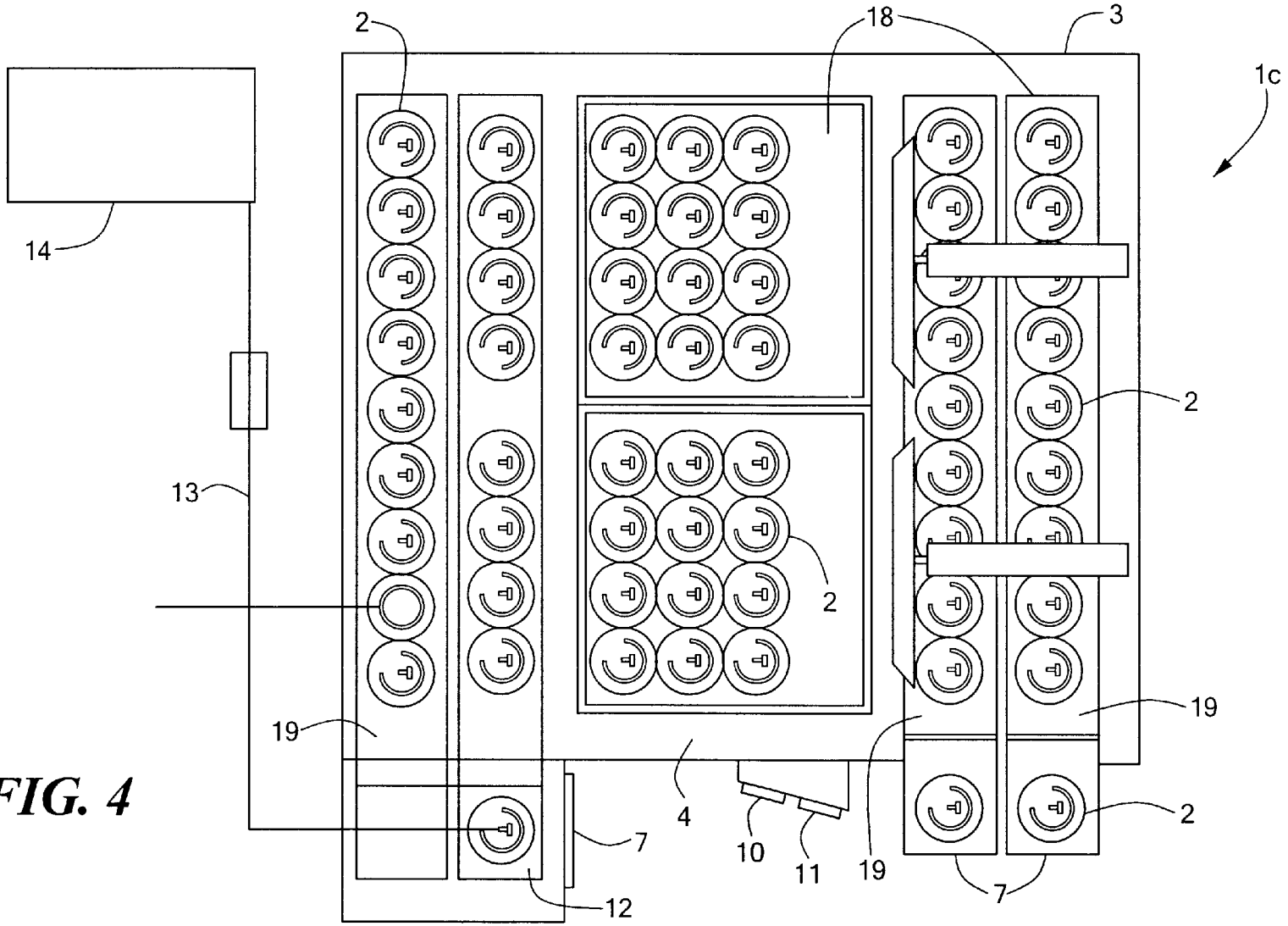
FIGS. 4 and 5 show further embodiments of an automatic sales apparatus according to the invention viewed from the top and from the front, respectively in which a receiver is provided instead of the transporters.
Figure 5:
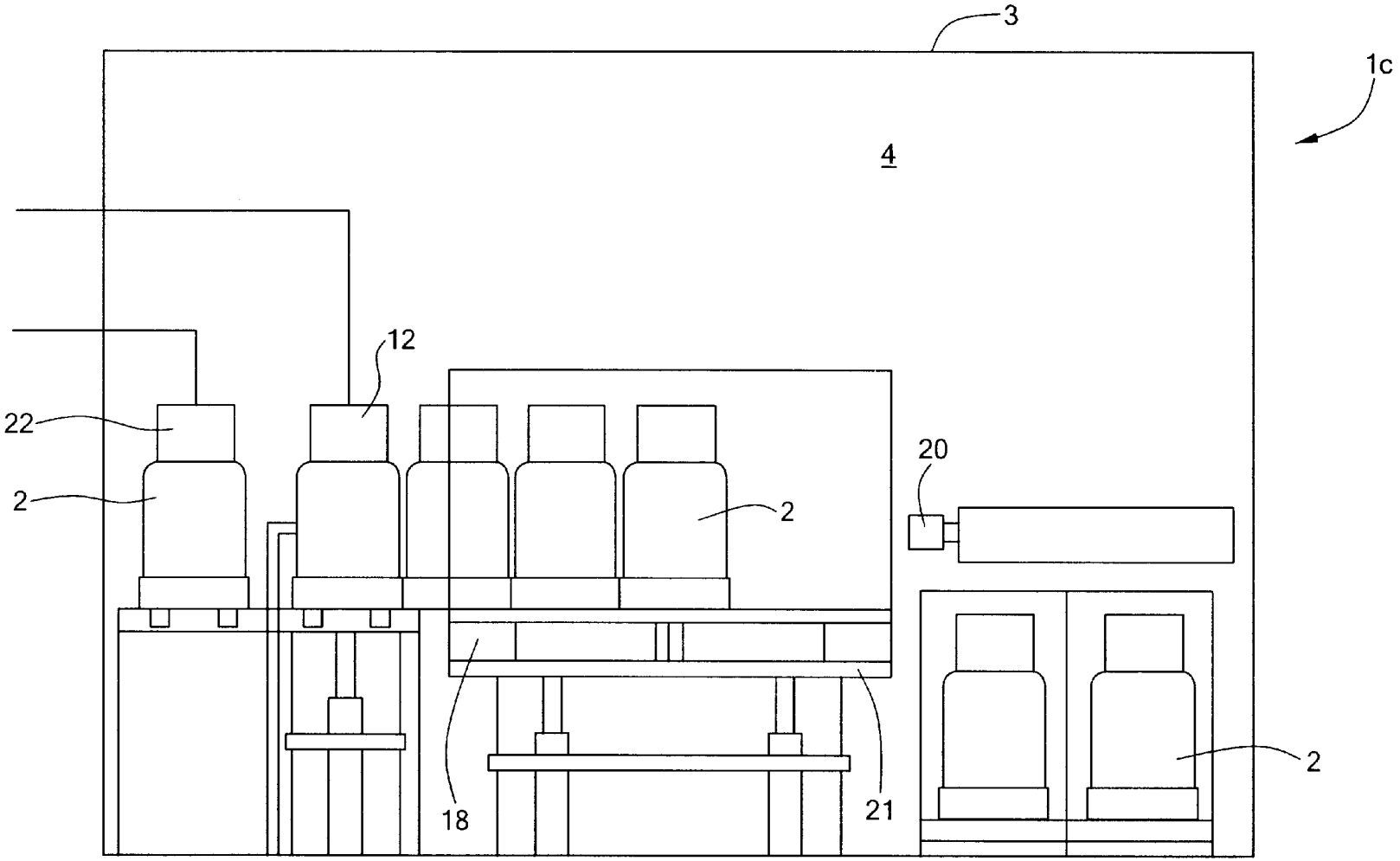

FIGS. 4 and 5 show simplified representations of an automatic sales apparatus 1*c* viewed from the top (FIG. 4) and from the front (FIG. 5) which differs inter alia from the automatic apparatus 1*a* in that a receiver or platform 21 that can be raised or lowered is provided for the pallets 18 and that instead of the transporters 19 and 19' two transporters 19 are provided on either side of the platform 21 but at different heights. By means of the raising and lowering platform 21 the transporters 19 can be serviced at different levels and also pallets 18 may be stacked one on top of the other.

The bottle delivery points are again denoted by 7, two being provided, for the left and right transporters 19. In particular in the automatic sales apparatus 1*c* provision is made for the empty gas bottles 2 in the automatic apparatus to be filled automatically with gas whereby leakage testing is carried out automatically and defective gas bottles are removed after extracting any residual gas, i.e., they are transferred to a pallet 18 for removal and repair.

In the automatic gas apparatus 1*c* automatic filling is carried out by the local filling station 12 through which the gas bottles 2 pass before they are delivered to the left output 7 in the figure. The local filling station 12 or an equivalent filling station is also provided for the direct filling of own gas bottles, i.e. those provided by the consumer.

The following operating mode is possible with the automatic sales apparatus 1*c*. This automatic sales apparatus is basically only designed for refilling of customers' own bottles 2 and for the sale of new gas bottles but not for the return of empty gas bottles 2. In normal operation a customer's own gas bottle to be refilled is inserted by the user in the filling station 12 at the left delivery point where the gas bottle is then filled and the filling process is monitored simultaneously at the same time. If a fault occurs, for example a leak, the gas bottle is moved via a transporter 19 into the automatic apparatus and the residual gas is extracted from this bottle at the extraction station 22. The user then either obtains a new empty gas bottle which is automatically filled by the filling station 12 or a ready filled gas bottle standing ready on the local transporter 19 at the right delivery point 7 in FIGS. 4 and 5.

E. Example 5

The automatic sales apparatus according to the invention can also be designed for the sale or filling of gas bottles with several different gases.

Figure 6:
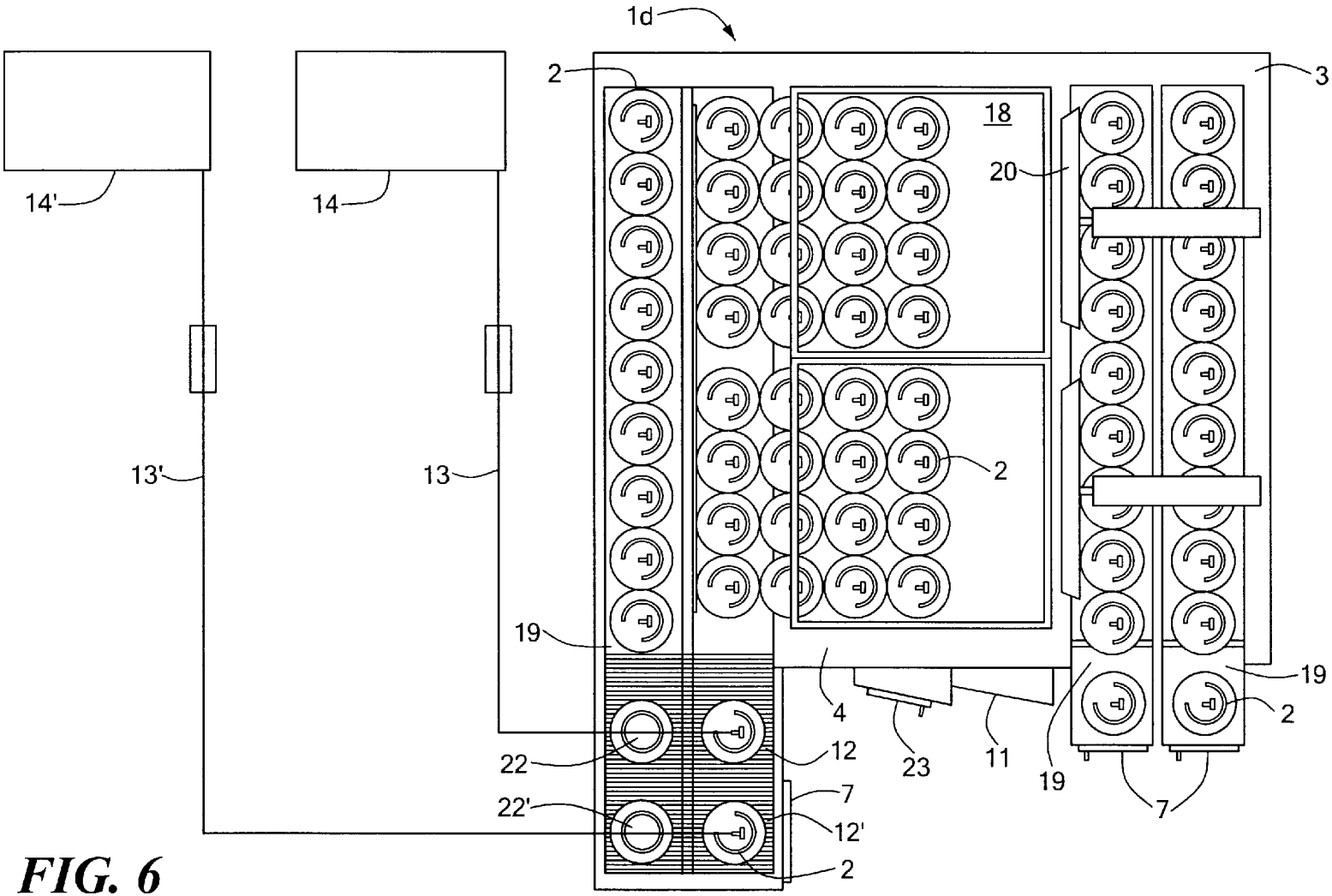
FIG. 6 shows yet another embodiment of an automatic sales apparatus according to the invention which is similar to the one presented in FIG. 4, but differs in being a twin system for the distribution of two kinds of gases.

An example for such a twin filling station is depicted in FIG. 6. The overall construction is similar to the one shown in FIG. 4. Therefore, the same numerals are used to designate corresponding elements of FIG. 6. This embodiment may also comprise a raising and lowering platform for implementing several different levels.

In the automatic gas apparatus 1*d* automatic filling is carried out by either of the local filling stations 12, 12' which are connected via pipes 13, 13' to two different gas tanks 14, 14' which may contain different gases. For instance, tank 14 may contain butane, while tank 14' may contain propane. It is of course also possible to provide both tanks 14, 14' with the same gas, if need be, for example to fulfill a high demand for a particular gas without having to exchange a tank for a bigger one.

The operating mode of this embodiment of the invention corresponds to the one described with reference to apparatus 1*c*, except that the customer may additionally select which gas should be filled into the bottle 2. Alternatively, provisions may be provided to automatically determine which gas should be refilled into the bottle 2, e.g. if regulations require the use of particular bottles for a specific gas.

Each of the two transporters 19 on the right side of FIG. 6 may be loaded with bottles 2 containing a different kind of gas. In case of a bottle leak or another fault, only the delivery point 7 giving access to bottles 2 containing the gas the customer wants to buy will be unlocked.

Gas bottles being stored on the means of transport or pallet 18 can be transported to either of the two filling stations 12, 12', provided that the bottles are suitable for both kinds of gases.

It goes without saying that this concept may also be expanded to even more filling stations 12, e.g. three of four filling stations.

Also shown in FIG. 6 is an accessory supply 23 which may deliver accessories needed for the purchase of a gas bottle, e.g. due to national regulations. For instance, a cap for covering the bottle's valve may be required.

The invention was described with reference to examples of embodiment. It is quite clear that numerous changes and modifications are possible without the concept forming the basis of the invention being lost. For example, in the automatic sales apparatus 1*a* and 1*b* the pallets 18 with the appropriate bottles inside the housing 3 can be arranged in several layers one on top of the other, for example in a suitable shelf configuration whereby the transporters 19 and 19' can be moved up and down vertically in order to service the pallets 18 in all the levels.

It is also possible to design the automatic sales apparatus 1, 1*a* and 1*b* such that before a bottle is delivered, it is automatically filled with gas by the appropriate automatic sales apparatus and directly after a bottle has been ordered by a customer and/or placed in stock.

Instead of the pallets 18 other means of transport can be provided, for example magazines, containers or container-like equipment or installations to receive a plurality of bottles. The functional elements used to deliver or return bottles are for example, motor (electrical motor), hydraulically or pneumatically driven.

VII. LIST OF SYMBOLS

| | |
|---|---|
| 1, 1a, 1b, 1c, 1d | Automatic sales apparatus for gas |
| 2 | Gas bottle |

-continued

VII. LIST OF SYMBOLS

| | |
|---|---|
| 3 | Housing |
| 4 | Interior of housing |
| 5 | Receiver |
| 6 | Turntable |
| 7 | delivery point |
| 7' | Bottle feed |
| 8 | Control electronics |
| 9 | Sensor |
| 10 | Display |
| 11 | Control panel |
| 12, 12' | Filling station |
| 13, 13' | Gas pipe |
| 14, 14' | Tank |
| 15 | Sensor |
| 16 | Filling head |
| 17 | Enclosure |
| 18 | Means of transport or pallet |
| 19, 19' | Transporter |
| 20 | Pushing device |
| 21 | Platform that can be raised or lowered |
| 22, 22' | Extraction device |
| 23 | accessory supply |

What is claimed:

1. Process for distributing gas in gas bottles with a distribution system having a filling station (12, 12') and a reservoir (3) for gas bottles, comprising the following step:

automatically evaluating if a new gas bottle (2) is required for distributing a gas selected by a consumer, characterized in that the distribution system comprises a filling station (12) and a reservoir (3) containing prefilled bottles, with a bottle delivery point (7), and that at least one of the actions is selected based on evaluating:

if the consumer provides a suitable bottle to the filling station, refilling the gas bottle;

if the consumer provides a defective or unsuitable gas bottle, or a fault occurs during the refilling of the gas bottle, providing a prefilled gas bottle from the reservoir to the delivery point;

if the consumer provides an unaccepted gas bottle, rejecting that gas bottle; and if the tank (14) of the filling station is empty, providing a prefilled gas bottle from the reservoir to the delivery point (7).

2. Process for distributing gas in gas bottles with a distribution system having a filling station (12, 12') and a reservoir (3) for gas bottles, comprising the following step:

automatically evaluating if a new gas bottle (2) is required for distributing a gas selected by a consumer;

characterized in that the distribution system comprises a filling station (12) and a reservoir (3) containing empty bottles, with a bottle delivery point (7), and that at least one of the actions is selected based on evaluating:

if the consumer provides a suitable gas bottle (2) to the filling station (12, 12'), refilling that gas bottle (2);

if the consumer provides a defective or unsuitable gas bottle (2), or a fault occurs during the refilling of the gas bottle (2), providing an empty gas bottle (2) from the reservoir (3) to the delivery point (7); and if the consumer provides an unaccepted gas bottle (2), rejecting that gas bottle (2).

3. Process according to claim 2, characterized in that the distribution system indicates to the consumer to insert the empty gas bottle (2) provided from the reservoir (3), into the filling station (12, 12').

4. Process for distributing gas in gas bottles with a distribution system having a filling station (12, 12') and a reservoir (3) for gas bottles, comprising the following step:

automatically evaluating if a new gas bottle (2) is required for distributing a gas selected by a consumer;

characterized in that the distribution system comprises a filling station (12, 12') and a reservoir (3) containing prefilled bottles, with a bottle delivery point (7) and a bottle feed (7'), and that at least one of the actions is selected based on evaluating:

if the consumer provides a suitable gas bottle (2) to the filling station (12, 12'), refilling that gas bottle (2);

if the consumer provides a defective or unsuitable gas bottle (2), or a fault occurs during the refilling of the gas bottle (2), providing a prefilled gas bottle (2) from the reservoir (3) to the delivery point (7);

if the consumer provides an unaccepted gas bottle (2), rejecting that gas bottle (2);

if the tank (14) of the filling station (12, 12') is empty, providing a prefilled gas bottle from the reservoir to the delivery point (7); and if the consumer returns a gas bottle (2) to the reservoir via the bottle feed (7'), providing a prefilled gas bottle (2) from the reservoir (3) to the delivery point (7).

5. Process for distributing gas in gas bottles with a distribution system having a filling station (12, 12') and a reservoir (3) for gas bottles, comprising the following step:

automatically evaluating if a new gas bottle (2) is required for distributing a gas selected by a consumer;

characterized in that the distribution system comprises a filling station (12, 12') and a reservoir (3) containing empty bottles, with a bottle delivery point (7) and a bottle feed (7'), and that at least one of the actions is selected based on evaluating:

if the consumer provides a suitable bottle (2) to the filling station (12, 12'), refilling that gas bottle (2);

if the consumer provides a defective or unsuitable gas bottle (2), or a fault occurs during the refilling of the gas bottle (2), providing an empty gas bottle (2) from the reservoir (3) to the delivery point (7);

if the consumer provides an unaccepted gas bottle (2), rejecting that gas bottle (2); and if the consumer returns a gas bottle (2) to the reservoir (3) via the bottle feed (7'), providing another, empty gas bottle (2) from the reservoir to the delivery point (7).

6. Process for distributing gas in gas bottles with a distribution system having a filling station (12, 12') and a reservoir (3) for gas bottles, comprising the following step:

automatically evaluating if a new gas bottle (2) is required for distributing a gas selected by a consumer;

characterized in that the distribution system comprises a filling station (12, 12') and a reservoir (3) containing prefilled gas bottles, with a bottle delivery point (7) and a transporter for transporting empty gas bottles (2) from the reservoir (3) to the filling station (12, 12') and for transporting defective or unsuitable gas bottles (2) from the filling station to the reservoir, and that at least one of the actions is selected based on evaluating:

if the consumer provides a suitable gas bottle (2) to the filling station, refilling the gas bottle;

if the consumer provides a defective or unsuitable gas bottle (2), or a fault occurs during the refilling of the gas bottle (2), transporting the defective or unsuitable gas bottle (2) to the reservoir (3) and providing an empty gas bottle (2) from the reservoir to the filling station (12, 12') and filling the gas bottle (2);

if the consumer provides an unaccepted gas bottle (2), rejecting that gas bottle (2);

if the tank (14) of the filling station (12, 12') is empty, providing a prefilled gas bottle (2) from the reservoir (3) to the delivery point (7); and if no empty gas bottles (2) are contained in the reservoir (3), providing a prefilled gas bottle (2) from the reservoir (3) to the delivery point (7).

7. A distribution system for gas in gas bottles with a reservoir (3) for gas bottles (2) from which the gas bottles (2) can be removed with controlled access and/or to which the gas bottles (2) can be preferentially returned with controlled access characterized in that the distribution system comprises means for automatically evaluating if a new gas bottle (2) is required for distributing a gas selected by a consumer, and outside the reservoir (4) at least one filling station (12) is provided to fill the gas bottles (2) with the gas.

8. A distribution system according to claim 7 characterized in that the reservoir (3) is designed to accommodate at least one means of transport (18) for gas bottles (2) and is provided with means to remove and/or insert gas bottles (2) from off the means of transport (18).

9. A distribution system according to claim 8 characterized in that the means of transport are pallets (18) or magazines or containers or container-like devices.

10. A distribution system according to claim 7 characterized in that in the reservoir (3) there is provided a receiving system (6) having several receivers (5) for one gas bottle each (2) and that each receiver (5) can be moved to a delivery point (7) and/or bottle feed (7') for a gas bottle (2).

11. A distribution system according to claim 7 characterized in that for controlled access there is provided at least one controlled delivery point (7) and/or controlled bottle feed (7').

12. A distribution system according to claim 7 characterized in that for controlled access to the reservoir (3) and/or to the filling station (12) there is provided at least one sensor (9, 15) which interacts with a bottle identification on the bottle (2), for example, with a chip, a transponder, with a strip or colour coding on the bottle (2) and/or an image recognition device.

13. A distribution system according to claim 7 characterized by means for automatically filling the bottles.

14. A distribution system for gas in gas bottles with a reservoir (3) for gas bottles (2) from which the gas bottles (2) can be removed with controlled access and/or to which the gas bottles (2) can be preferentially returned with controlled access characterized in that the distribution system comprises means for automatically evaluating if a new glass bottle (2) is required for distributing a gas selected by a consumer, and the reservoir (3) is designed to accommodate at least one means of transport (18) for gas bottles (2) and is provided with means to remove and/or insert gas bottles (2) from off the means of transport (18).

15. A distribution system according to claim 14 characterized in that outside the reservoir (4) at least one filling station (12) is provided for filling the gas bottles (2) with the gas.

16. A distribution system according to claim 14 characterized in that in the reservoir (3) there is provided a receiving system (6) having several receivers (5) for one gas bottle each (2) and that each receiver (5) can be moved to a delivery point (7) and/or bottle feed (7') for a gas bottle (2).

17. A distribution system according to claim 14 characterized in that for controlled access there is provided at least one controlled delivery point (7') and/or controlled bottle feed (7').

18. A distribution system according to claim 14 characterized in that for controlled access to the reservoir (3) and/or to the filling station (12) there is provided at least one sensor (9, 15) which interacts with a bottle identification on the bottle (2), for example, with a chip, a transponder, with a strip or colour coding on the bottle (2) and/or an image recognition device.

19. A distribution system according to claim 14 characterized by means for automatically filling the bottles.

20. A distribution system according to claim 14 characterized in that the means of transport are pallets (18) or magazines or containers or container-like devices.

* * * * *